US006501215B1

(12) United States Patent
Kim

(10) Patent No.: US 6,501,215 B1
(45) Date of Patent: Dec. 31, 2002

(54) SHRINKAGE BAND FOR CRT WITH OPTIMIZATION CONDITION INEQUALITIES

(75) Inventor: Yong Kun Kim, Kumi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/572,779

(22) Filed: May 17, 2000

(30) Foreign Application Priority Data

May 18, 1999 (KR) ..... 1999-17826

(51) Int. Cl.[7] ..... H01J 31/00

(52) U.S. Cl. ..... 313/477 R; 313/477 HC; 313/479; 348/822

(58) Field of Search ..... 313/479, 477 HC, 313/477 R; 348/822, 823, 824

(56) References Cited

U.S. PATENT DOCUMENTS 4,121,257 A * 10/1978 Krishnamurthy ..... 220/2.1 A
4,356,515 A * 10/1982 Sumiyoshi et al. ..... 220/2.1 A
4,930,015 A * 5/1990 Dougherty et al. ..... 358/246
5,216,513 A * 6/1993 Swank ..... 220/2.1 A
5,743,778 A * 4/1998 Arimoto et al. ..... 313/461
6,259,206 B1 * 7/2001 Tsuchiya et al. ..... 313/2.1

* cited by examiner

*Primary Examiner*—Nimeshkumar D. Patel
*Assistant Examiner*—Glenn Zimmerman
(74) *Attorney, Agent, or Firm*—Fleshner & Kim, LLP

(57) ABSTRACT

A shrinkage band for a CRT including: a panel forming a display screen; and a shrinkage band having a predetermined width combined to cover the outer circumferential surface of the side portion of the panel in a state of satisfying an inequality of $0.95 \leqq F_a/F_b \leqq 1.39$ on the assumption that an engagement tensile force of the front side of the panel is $F_a$ and that of the opposite side of the front side of the panel is $F_b$ on the basis of the line extended in the horizontal direction of the panel from the center of the curved portion of the corner of the inner side of the flat panel. With the construction, the explosion characteristics of the flat panel can be highly improved along with an effectiveness that a reliability can be enhanced and a stability in use can be obtained.

15 Claims, 4 Drawing Sheets

SHRINKAGE BAND FOR CRT WITH OPTIMIZATION CONDITION INEQUALITIES

BACKGROUND OF THE INVENTION

1. Field of the Invention

The present invention relates to a shrinkage band for a CRT, and more particularly, to a shrinkage band combined to a CRT adopting a panel with a flat outer surface and a curved inner surface recently emerging as a new trend, which is capable of preventing occurrence of a explosion phenomenon on the panel.

2. Description of the Background Art

As is widely known, a CRT is a display instrument used for an observation of an oscilloscope or a radar as well as a television set.

The CRT serves to transmit a color image for users' viewing which is reproduced in a manner that a phosphor screen consisting of fluorescein pixels, that is, an electrooptic device, converting a video data received as an electric signal to a visual information, graphite, that is, an optical absorption substance, and an aluminum film improving a luminance, is hit by an electronic beam.

FIG. 1 illustrates a construction of a general CRT in accordance with a conventional art.

As shown in the drawing, the conventional CRT includes a panel 1 positioned in the front surface and a funnel 2 adhesively attached to the rear end of the panel 1, forming a vacuum outer casing container.

An electric gun 5 radiating an electric beam 4 is hermetically sealed inside a neck portion 3, that is, the end portion having relatively smaller diameter in the funnel 2. A deflection yoke 9 for generating a pin-cushion-type horizontal deflection magnetic field and barrel-type vertical deflection magnetic field, is mounted in the outer circumferential side in the vicinity of the neck portion 3, so as to deflect the radiated electronic beam to the whole screen.

A phosphor film 6 is formed on the inner surface of the panel 1, and a shadow mask 7 having a section-based electrode function is supported by a frame 8 installed therein, spaced apart at a predetermined distance from the phosphor film 6.

In the conventional CRT constructed as described above, the electronic beam 4 radiated from the electronic gun 5 is deflected to a desired portion of a screen by the vertical and horizontal deflection magnetic fields of the deflection yoke 9, and as the electronic beam passes through a plurality of through holes (not shown) formed at the shadow mask 7, it hits the phosphor film 6, thereby creating a picture.

Since the inside of the conventional CRT constructed as above makes a vacuum state by the panel 1 and the funnel 2, a stress is applied to the panel due to an external atmosphere pressure. That is, as shown in FIG. 2, according to the structural characteristics of the CRT, the front surface portion of the panel 1 receives a compressive stress while the side portion thereof receives a tension stress.

Thus, in a state that the compressive stress and the tension stress work due to the vacuum, when an external impact is applied to the CRT, a explosion phenomenon possibly causing that the panel 1 or the funnel 2 is exploded may occur, which, thus, causes a malfunction to the CRT as well as threatening users' safety.

In order to prevent such a explosion phenomenon, a shrinkage band 10 is typically combined to continuously cover the external side portion of the panel 1.

The panel 1 is formed of a glass, which is weaker over the tension stress compared to the compressive stress in its property, and accordingly, the side portion of the panel 1 is structurally weaker compared to the front surface portion thereof.

Therefore, the shrinkage band 10 is combined to the CRT so as to strengthen the rigidity of the side portion of the panel 1 where the tension stress is concentrated, to thereby prevent the explosion phenomenon.

In detail, when an impact is applied to the surface of the CRT, a deformation stress, that is, a tension stress, expanding the side portion of the CRT is generated, which is, however, restrained by the rigidity of the shrinkage band 10 that compresses the side portion, so that a crack possibly caused passing the side portion and the surface portion can be restrained or the speed of the crack can be lowered down. And, at the same time, the direction of the main stress to the surface portion of the panel 1 and the proceeding direction of the crack are changed, thereby preventing the explosion phenomenon.

According to a research, the maximum tension stress working on the side portion of the panel 1 was observed by 87.9 kgf/cm$^2$ without the shrinkage band 10, while when the shrinkage band is combined to the side portion of the panel 1, the maximum tension stress was observed by 79.0 kgf/cm$^2$.

The panel 1 is typically fabricated by molding. When the panel is fabricated by molding, a mold match line is formed in the panel 1, and the shrinkage band 10 is generally combined to the CRT in a manner that it covers the mold match line 11, as shown in FIGS. 3A–3B.

Referring to kinds of the shrinkage bands, there are a straight line-type shrinkage band 10' which is directed to highly improve an adherence of the shrinkage band itself for heightening the compression efficiency as shown in FIG. 3A and a fold-type shrinkage band 10" directed to strengthening a compression force in the front portion of the panel 1 as shown in FIG. 3B.

Theoretically, though it is desired to install the shrinkage band 10" on the basis of the center of the curved portion of the corner portion, making a break-even point of the compression efficiency, of the inner surface of the panel 1, since the mold match line 11 and the position of the center of the curved portion of the corner are almost the same owing to the spherical panel form, substantially the mold match line 11 is easily identified in view of form is used as an installment reference to the shrinkage band 10.

In detail, since, on the basis of the mold match line 11, the upper portion of the shrinkage band 10 compresses the front portion of the panel 1 and the lower portion of the shrinkage band 10 compresses a skirt portion of the panel 1, the shrinkage band 10 is to be positioned suitably on the basis of the mold match line 11 in order to improve a explosion prevention capacity.

For example, if the shrinkage band 10 is inclined toward the lower portion (the skirt portion of the panel 1) of the mold match line 11, many cracks can be made in the CRT due to an external impact, or in a worse case, the panel 1 may be separated from the CRT.

Reversely, if the shrinkage band 10 is inclined toward the upper portion (the front portion of the panel 1) of the mold match line 11, a explosion or a crack can be easily made in the skirt portion of the panel 1 due to an external impact.

Actually, when the shrinkage band 10 is combined to the CRT, in order to accomplish optimum explosion-proof characteristics, the mold match line 11 is typically designed in a manner that the compression force of the upper portion is weak compared to that of the lower portion. Taking an example that the spherical panel as in the conventional art is adopted to the CRT, it is designed in a manner that the compression force of the upper portion of the mold match line 11 does not go beyond 90% compared to the compression force of the lower portion.

As another way of preventing the explosion, besides the shrinkage band 10, a strong glass having an improved explosion prevention characteristics by heightening its rigidity may be used for the panel 1, or a film may be attached onto the surface of the panel 1 so as to provide a explosion prevention function.

Meanwhile, recently, as a screen is turning large-sized and flat in order to provide a distinct image, there has been proposed a panel (termed as a 'flat panel', hereinafter) of which an outer surface is flat while inner surface is curved. This kind of panel offers a distinct image compared to the general spherical panel as used in conventional arts, implementing a highly-refined picture, but the corner portion of the panel is formed thick compared to that of the general spherical panel.

That is, the thickness ratio between the center and the corner of the general spherical panel is approximately 1.3, while in case of the flat panel, the thickness ratio between the center and the corner is approximately 1.8~2.0.

Accordingly, in case that the reference for distribution of the compression force of the shrinkage band of the flat panel is applied by the mold match line in the same manner as in the case of general spherical panel, the position of the shrinkage band becomes relatively inclined backwardly of the panel, causing a weakness in the front side of the panel, which creates a problem in that there is a high possibility that a crack or a explosion is made in the front side of the panel.

Meanwhile, in order to prevent such a explosion phenomenon, the strong glass may be employed to the panel or the film may be attached onto the surface of the panel. However, in the former case, a production cost is inevitably increased in spite of the explosion prevention effect, while in the latter case, its expense is increased and recycling is impossible.

SUMMARY OF THE INVENTION

Therefore, an object of the present invention is to provide a shrinkage band for a CRT combined to a flat panel in a suitable position which is determined from the forward or backward direction of the panel on the basis of a line extended in the horizontal direction from the center of the curved portion of the corner of the inner side of the flat panel, so as to prevent a explosion phenomenon on the flat panel.

To achieve these and other advantages and in accordance with the purposed of the present invention, as embodied and broadly described herein, there is provided a shrinkage band for a CRT including: a panel forming a display screen; and a shrinkage band having a predetermined width combined to cover the outer circumferential surface of the side portion of the panel in a state of satisfying an inequality $0.95 \leqq F_a/F_b \leqq 1.39$ on the assumption that an engagement tensile force of the front side of the panel is $F_a$ and that of the opposite side of the front side of the panel is $F_b$, on the basis of the line extended in the horizontal direction of the panel from the center of the curved portion of the corner of the inner side of the flat panel.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
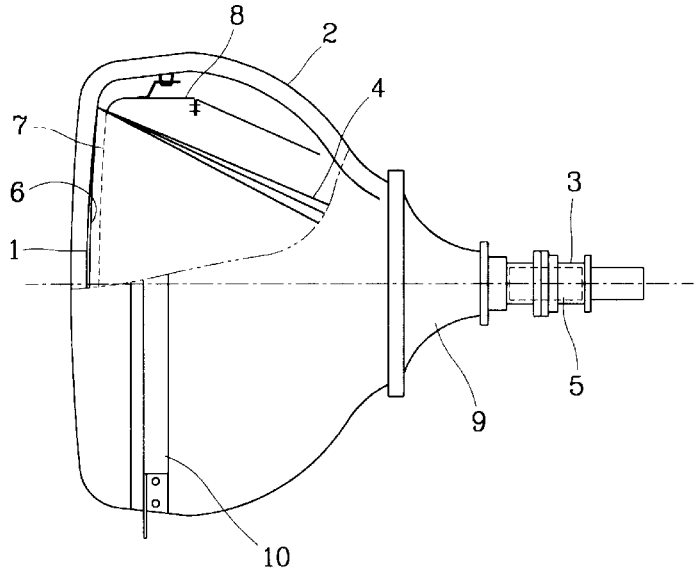
FIG. 1 PRIOR ART
FIG. 1 illustrates a construction of a general CRT in accordance with a conventional art.
Figure 2:
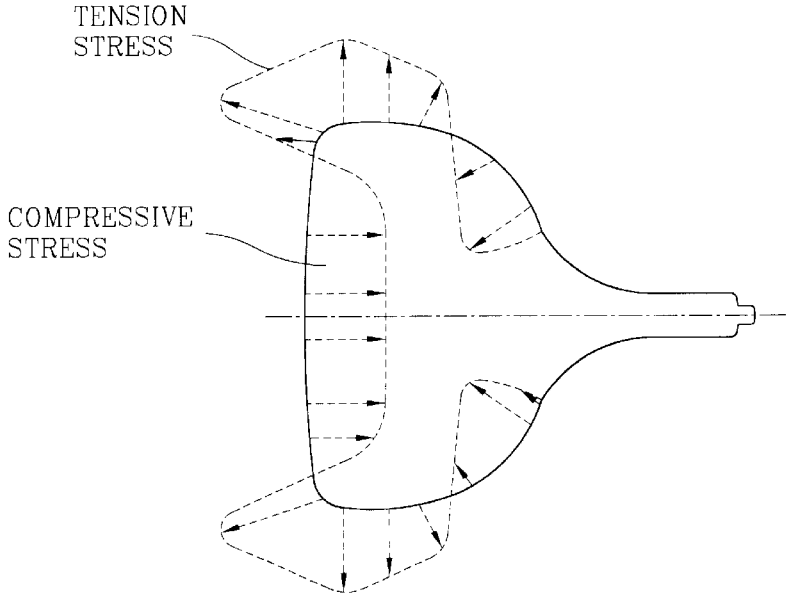
FIG. 2 PRIOR ART
FIG. 2 illustrates a stress distribution of the general CRT in accordance with the conventional art.
Figure 3A:
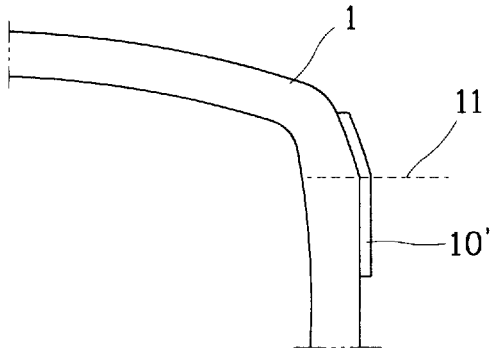
FIG. 3A PRIOR ART
FIG. 3A is a partial view showing a straight line-type shrinkage band combined to the general CRT in accordance with the conventional art.
Figure 3B:
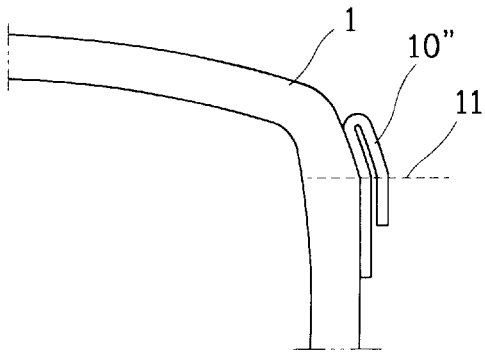
FIG. 3B PRIOR ART
FIG. 3B is a fold-type shrinkage band combined to the general CRT in accordance with the conventional art.

Reference will now be made in detail to the preferred embodiments of the present invention, examples of which are illustrated in the accompanying drawings.

There may be plurality of embodiments of the present invention, and the most preferred embodiment is described in detail hereinbelow, though which objects and advantages of the present invention will be understood enough. In explanation for the drawings, the same reference numerals are given for the same construction elements in FIG. 1 through FIG. 3B, for which the same descriptions are omitted.

The present invention is directed to combine a shrinkage band at an optimum position to a flat panel, that is recently spotlighted, in order to prevent an occurrence of a explosion phenomenon.

In this respect, referring to the flat panel, if the shrinkage band is combined on the basis of a mold match line, since there is much difference between the thickness of the center portion and that of the corner portion of the flat panel, relatively, there is a high possibility that a explosion phenomenon occurs in the front surface portion of the flat panel.

Figure 5A:
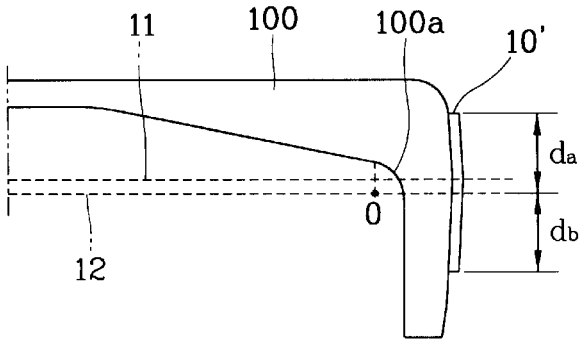
FIG. 5A is a partial view of a straight line-type shrinkage band combined to the CRT in accordance with first embodiment of the present invention.
Figure 5B:
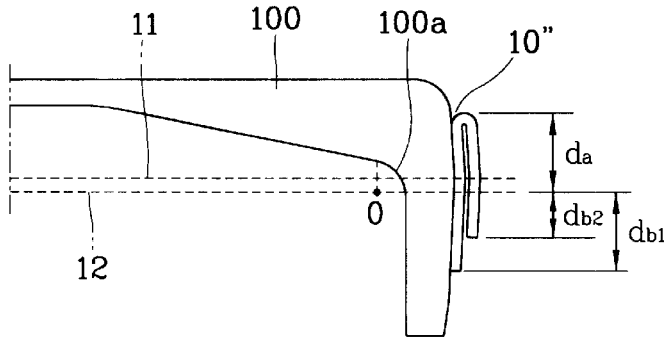
FIG. 5B is a partial view showing that a folded portion of the fold-type shrinkage band combined to the CRT is extended to the lower portion of the center of the curved side of the corner portion of the inner surface of the panel in accordance with a second embodiment of the present invention.
Figure 5C:
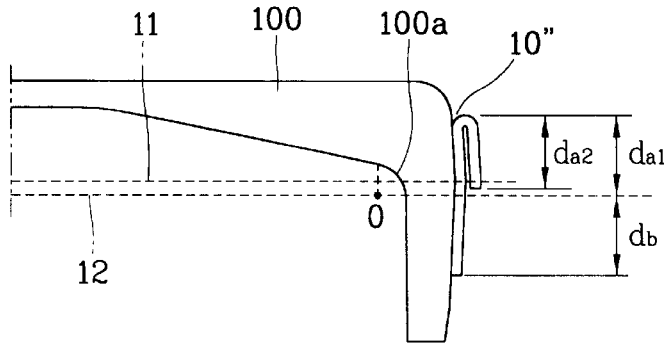
FIG. 5C is a partial view showing that the folded portion of the fold-type shrinkage band combined to the CRT is positioned at the upper portion of the center of the curved side of the corner portion of the inner surface of the panel in accordance with a third embodiment of the present invention.

Accordingly, as to the flat panel 100 adopted to the present invention, the curvature is steeply changed at the corner portion 100*a*, and generally, the compression effectiveness diverges on the basis of the center 'O' of the curvature of the corner portion 100*a*, so that, as shown in FIGS. 5A and 5C, the installation of the shrinkage band is set on the basis of the line 12 extended in the horizontal direction of the panel 100 from the curvature center 'O' of the corner portion 100*a* of the inner surface of the flat panel 100.

Generally, the engagement tensile force (F) of the shrinkage band is computed by an equation of $F=\sigma\times T\times d$ ($\sigma$ indicates an yield strength, T indicates the thickness of the shrinkage band, and W indicates the width of the shrinkage band). In this respect, since the thickness of the shrinkage band combined to an arbitrary CRT and its yield strength are generally the same for any shrinkage band, the engagement tensile force (F) is considered to be in proportion to the width of the shrinkage band.

Figure 4:
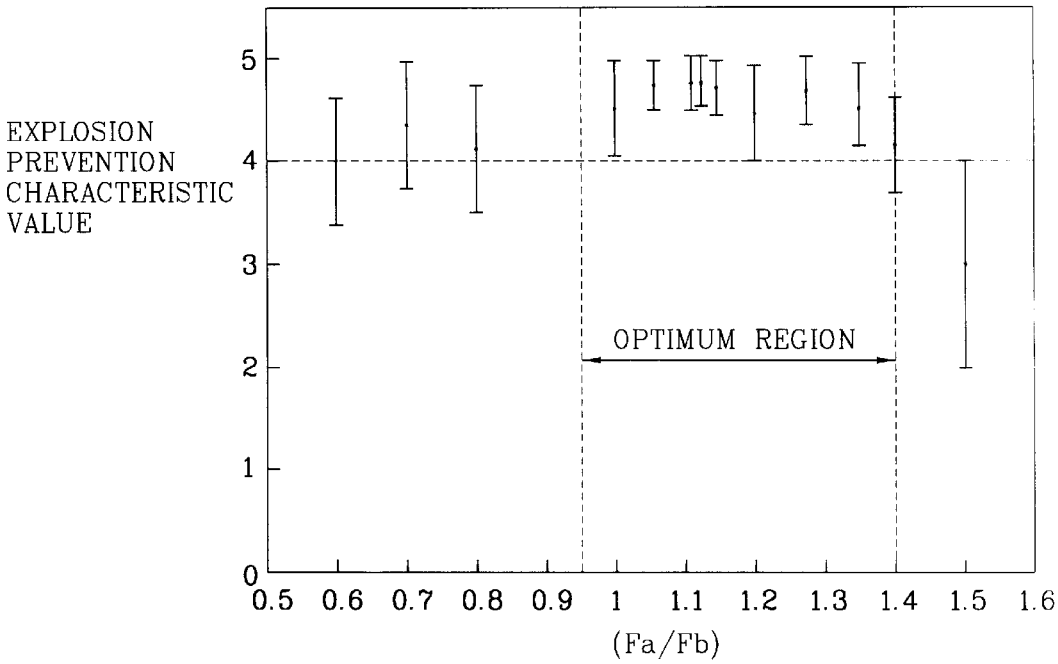
FIG. 4 is a graph showing a proof-explosion property of the shrinkage band combined to a CRT in accordance with the present invention.

FIG. 4 is a graph showing a result of an experiment on explosion characteristics, for which a shrinkage band is combined while changing the engagement tensile forces on the basis of the line 12 extended in the horizontal direction of the panel 100 from the curvature center 'O' of the corner portion 100*a* of the inner surface of the flat panel 100.

In detail, in case that the shrinkage band is positioned to be inclined to the lower portion side (the front portion of the panel 100 is termed as the 'upper portion' while the opposite portion to the front portion of the panel 100 is the 'lower portion', hereinafter) on the basis of the line 12 extended in the horizontal direction of the panel 100 from the curvature center 'O' of the corner portion 100*a*, the engagement tensile force (F) of the upper portion of the flat panel 100 is relatively weaker than that of the lower portion of the flat panel 100, so that when an external impact works on the surface of the flat panel 100, a large amount of crack can occur on the surface of the flat panel 100 due to the impact, and in a worse case, there is a possibility that the surface of the flat panel 100 is separated from the CRT Conversely, in case that the shrinkage band is positioned to be inclined to the upper portion side on the basis of the line 12 extended in the horizontal direction of the panel 100 from the curvature center 'O' of the corner portion 100*a* (for example, in case that the engagement tensile force of the upper portion is relatively 40% greater than that of the lower portion), when an external impact is applied to the surface of the flat panel 100, a progressive crack may occur as time goes by after the impact.

At this time, though the band strongly compresses the upper portion to prevent the external impact from dispersively transmitting from the upper portion to the lower portion of the flat panel 100, a check mark that a minor flaw occurs on the flat panel 100 appears as well as a possibility of a explosion.

Therefore, the shrinkage band should be suitably positioned on the basis of the line 12 extended in the horizontal direction of the panel 100 from the curvature center 'O' of the corner portion 100*a* of the inner surface of the flat panel 100, for which an optimum engagement tensile force ratio for the shrinkage band is shown in the below inequality [1] as illustrated in FIG. 4.

$$0.94 \leqq F_a/F_b \leqq 1.39 \quad [1],$$

where $F_a$ indicates an engagement tensile force of the front portion of the panel of the shrinkage band on the basis of the line 12 extended in the horizontal direction of the panel 100 from the curvature center 'O' of the corner portion 100*a* of the inner surface of the flat panel 100, and $F_b$ indicates an engagement tensile force of the opposite side to the front portion of the panel of the shrinkage band on the basis of the line 12 extended in the horizontal direction of the panel 100 from the curvature center 'O' of the corner portion 100*a* of the inner surface of the flat panel 100.

In this respect, as aforementioned, since the yield strength and the thickness of the shrinkage band to be combined to an arbitrary CRT are the same for any shrinkage band, the engagement tensile force of the shrinkage band is proportional to the width of the shrinkage band.

Accordingly, the ratio of the engagement tensile force of the shrinkage band can be expressed by a ratio of the width of the shrinkage band, which will now be explained according to embodiments in view of a combined type of the shrinkage band.

FIG. 5A illustrates a straight line-type shrinkage band 10'.

In the drawing, when the width of the upper portion of the shrinkage band 10' is $d_a$ and the width of the lower portion is $d_b$ on the basis of the line 12 extended in the horizontal direction of the panel 100 from the curvature center 'O' of the corner portion 100*a* of the inner surface of the flat panel 100, the engagement tensile force ratio of the shrinkage band 10' is determined only by the width of the shrinkage band, which can be expressed by the following inequality [2].

$$0.95 \leqq F_a/F_b = d_a/d_b \leqq 1.39 \quad [2]$$

Meanwhile, in case of the fold-type shrinkage band 10", the engagement tensile force of the shrinkage band 10" is different depending on how long the folded portion is extended on the basis of the line 12 extended in the horizontal direction of the panel 100 from the curvature center 'O' of the corner portion 100*a* of the inner surface of the flat panel 100.

That is, FIG. 5B shows a fold-type shrinkage band 10" of which the folded portion is extended to the lower portion of the line 12 extended in the horizontal direction of the panel 100 from the curvature center 'O' of the corner portion 100*a*.

In the drawing, assuming that the width of the upper portion of the shrinkage band 10" is $d_a$, the width of the lower portion of the shrinkage band 10" is $d_{b1}$, and the width of the lower portion of the folded portion of the shrinkage band 10" is $d_{b2}$, the engagement tensile force ratio of the shrinkage band 10" can be expressed by the following inequality [3].

$$0.95 \leqq F_a/F_b = (2\times d_a)/(d_{b1}+d_{b2}) \leqq 1.39 \quad [3]$$

Meanwhile, FIG. 5C shows a fold-type shrinkage band of which the folded portion is formed at the upper portion of the line 12 extended in the horizontal direction of the panel 100 from the curvature center 'O' of the corner portion 100*a*.

In the drawing, assuming that the width of the upper portion of the shrinkage band 10" is $d_{a1}$, the width of the upper portion of the folded portion of the shrinkage band 10" is $d_{a2}$ and the width of the lower portion of the shrinkage band 10" is $d_{b1}$ the engagement tensile force ratio of the shrinkage band 10" can be expressed by the following inequality [4]:

$$0.95 \leqq F_a/F_b = (d_{a1}+d_{a2})/d_b \leqq 1.39 \quad [4]$$

In this manner, the engagement tensile force ratio of the shrinkage band combined on the basis of the line 12 extended in the horizontal direction of the panel 100 from the curvature center 'O' of the corner portion 100*a* of the inner surface of the flat panel 100 can be expressed by the ratio of the width of the shrinkage band, and when the shrinkage band is combined to the flat panel by suitably setting the engagement tensile force ratio of the shrinkage band, the stress generated in the CRT is evenly distributed. And, when an external impact is applied onto the surface of the flat panel 100, the impulsive wave can be evenly dispersed to the surface and the skirt portion of the flat panel 100, so that an optimum explosion characteristics can be accomplished.

As so far described, according to the shrinkage band for a CRT of the present invention, the shrinkage band is suitably positioned to be combined to the flat panel gaining much popularity, so that the explosion characteristics of the flat panel can be highly improved along with an effectiveness that a reliability can be enhanced and a stability in use can be obtained.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A CRT, comprising:

a panel forming a display screen; and a shrinkage band having a predetermined width configured to cover an outer circumferential surface of a side portion of the panel in a state of satisfying the following equation:

$$0.95 \leqq F_a/F_b \leqq 1.39$$

where $F_a$ is an engagement tensile force of the shrinkage band on a front portion of the panel with respect to a reference line extending in a horizontal direction from a center of a curved portion of a corner of an inner side of the panel and $F_b$ is an engagement tensile force of the shrinkage band on a portion of the shrinkage band opposite to the front portion with respect to the reference line.

2. The CRT according to claim 1, wherein the shrinkage band is a straight line-shaped shrinkage band and satisfies the following equation:

$$0.95 \leqq d_a/d_b \leqq 1.39$$

where $d_a$ is a width of the shrinkage band on the front portion of the panel, and $d_b$ is a width of the shrinkage band on the portion of the panel opposite to the front portion of the panel.

3. The CRT according to claim 1, wherein the shrinkage band is a folded-shaped shrinkage band having a folded portion that extends onto the opposite portion of the panel with respect to the reference line and satisfies the following equation:

$$0.95 \leqq (2 \times d_a)/(d_{b1}+d_{b2}) \leqq 1.39$$

where $d_a$ is a width of the shrinkage band on the front portion of the panel, $d_{b1}$ is a width of the shrinkage band on the portion of the panel opposite to the front portion of the panel, and $d_{b2}$ is a width of the folded portion of the shrinkage band on the portion of the panel opposite to the front portion of the panel.

4. The CRT according to claim 1, wherein the shrinkage band is a folded-shaped shrinkage band having a folded portion formed on an upper portion of the panel with respect to the reference line and satisfies the following equation $$0.95 \leqq (d_{a1}+d_{a2})/d_b \leqq 1.39$$

where $d_{a1}$ is a width of the shrinkage band on the front portion of the panel, $d_{a2}$ is a width of the folded portion of the shrinkage band on the portion of the panel opposite to the front portion of the panel, and $d_b$ is a width of the shrinkage band on the portion opposite to the front portion of the panel.

5. An improved shrinkage band for a CRT having a panel forming a display screen, the shrinkage band being configured to cover an outer circumferential surface of a side portion of the panel, wherein the shrinkage band satisfies the following equation:

$$0.95 \leqq F_a/F_b \leqq 1.39$$

where $F_a$ is an engagement tensile force of a portion of the shrinkage band positioned on a front portion of the panel with respect to a reference line extending in a horizontal direction from a center of a curved portion of a corner of an inner side surface of the panel and $F_b$ is an engagement tensile force of a portion of the shrinkage band positioned on a rear portion of the panel with respect to the reference line.

6. The improved shrinkage band according to claim 5, wherein the shrinkage band is a straight line-type shrinkage band and satisfies the following equation:

$$0.95 \leqq d_a/d_b \leqq 1.39$$

where $d_a$ is a width of the shrinkage band on the front portion of the panel and $d_b$ is a width of the shrinkage band on the rear portion of the panel.

7. The improved shrinkage band according to claim 5, wherein the shrinkage band is a folded-shaped shrinkage band having a folded portion that extends onto the rear portion of the panel with respect to the reference line and satisfies the following equation:

$$0.95 \leqq (2 \times d_a)/(d_{b1}+d_b) \leqq 1.39$$

where $d_a$ is a width of the shrinkage band on the front portion of the panel, $d_{b1}$ is a width of the shrinkage band on the rear portion of the panel, and $d_{b2}$ is a width of the folded portion of the shrinkage band on the rear portion of the panel.

8. The improved shrinkage band according to claim 5, wherein the shrinkage band is a folded-shaped shrinkage band having a folded portion formed on the front portion of the panel and satisfies the following equation:

$$0.95 \leqq (d_{a1}+d_{a2})/d_b \leqq 1.39$$

where $d_{a1}$, is a width of the shrinkage band on the front portion of the panel, $d_{a2}$ is a width of the folded portion of the shrinkage band on the front portion of the panel, and $d_b$ is a width of the shrinkage band on the rear portion of the panel.

9. A shrinkage band for a CRT having a panel forming a display screen, the shrinkage band being configured to cover an outer circumferential surface of a side portion of the panel and comprising:

a first portion positioned on a front portion of the panel with respect to a reference line extending in a horizontal direction from a center of a curved portion of a corner of an inner side surface of the panel; and a second portion positioned on a rear portion of the shrinkage band with respect to the reference line, wherein the shrinkage band satisfies the following equation:

$$0.95 \leqq F_a/F_b \leqq 1.39$$

where $F_a$ is a tensile strength of the first portion, and $F_b$ is the tensile strength of the second portion.

10. The shrinkage band according to claim 9, wherein the shrinkage band is a straight like-type shrinkage band and satisfies the following equation:

$$0.95 \leqq d_a/d_b \leqq 1.39$$

where $d_a$ is a width of the first portion, and $d_b$ is a width of the second portion.

11. The shrinkage band according to claim 9, wherein the shrinkage band is a folded-shaped shrinkage band having a folded portion that extends onto the rear portion of the panel and satisfies the following equation:

$$0.95 \leqq (2 \times d_a)/(d_{b1}+d_{b2}) \leqq 1.39$$

wherein $d_{a1}$ is a width of the first portion, $d_{b1}$ is a width of the second portion, and $d_{b2}$ is a width of the folded portion extending onto the rear portion of the panel.

12. The shrinkage band according to claim 9, wherein the shrinkage band is a folded-shaped shrinkage band having a folded portion formed on the front portion of the panel and satisfies the following equation:

$$0.95 \leqq (d_{a1}+d_{a2})/d_b \leqq 1.39$$

where $d_{a1}$ is a width of the first portion, $d_{a2}$ is a width of the folded portion, and $d_b$ is a width of the second portion.

13. A shrinkage band for a CRT having a panel forming a display screen, the shrinkage band being configured to cover an outer circumferential surface of a side portion of the panel and comprising:

a first portion positioned on a front portion of the panel with respect to a reference line extending in a horizontal direction from a center of a curved portion of a corner of an inner side surface of the panel; and a second portion positioned on a rear portion of the shrinkage band with respect to the reference line, wherein the shrinkage band satisfies the following equation:

$$0.95 \leqq d_a/d_b \leqq 1.39$$

wherein $d_a$ is a width of the first portion, and $d_b$ is a width of the second portion.

14. A shrinkage band for a CRT having a panel forming a display screen, the shrinkage band being configured to cover an outer circumferential surface of a side portion of the panel and comprising:

a first portion positioned on a front portion of the panel with respect to a reference line extending in a horizontal direction from a center of a curved portion of a corner of an inner side surface of the panel;

a second portion positioned on a rear portion of the shrinkage band with respect to the reference line; and a folded portion, the folded portion being formed on the first portion and extending onto the rear portion of the panel, wherein the shrinkage band satisfies the following equation:

$$0.95 \leqq (2 \times d_a)/(d_{b1}+d_{b2}) \leqq 1.39$$

where $d_a$ is a width of the first portion, $d_{b1}$ is a width of the second portion, and $d_{b2}$ is a width of the folded portion extending onto the rear portion of the panel.

15. A shrinkage band for a CRT having a panel forming a display screen, the shrinkage band being configured to cover an outer circumferential surface of a side portion of the panel and comprising:

a first portion positioned on a front portion of the panel with respect to a reference line extending in a horizontal direction from a center of a curved portion of a corner of an inner side surface of the panel;

a second portion positioned on a rear portion of the shrinkage band with respect to the reference line; and a folded portion formed on the front portion of the panel, wherein the shrinkage band satisfies the following equation:

$$0.95 \leqq (d_{a1}+d_{a2})/d_b \leqq 1.39$$

wherein $d_{a1}$ is a width of the first portion, $d_{a2}$ is a width of the folded portion, and $d_b$ is a width of the second portion.

* * * * *